US005247806A

United States Patent [19]

Ebisu et al.

[11] Patent Number: 5,247,806

[45] Date of Patent: Sep. 28, 1993

[54] MULTI-SYSTEM AIR CONDITIONER

[75] Inventors: Koji Ebisu, Katano; Yoshiaki Doyama, Hirakata; Masataka Ozeki, Osaka; Masami Funakura, Hirakata; Yuji Yoshida, Itami; Kanji Haneda, Kusatsu, all of Japan

[73] Assignee: Matsushita Electric Industrial Co., Ltd., Osaka, Japan

[21] Appl. No.: 745,352

[22] Filed: Aug. 15, 1991

[30] Foreign Application Priority Data

| | | | |
|---|---|---|---|
| Aug. 20, 1990 | [JP] | Japan | 2-219257 |
| Oct. 29, 1990 | [JP] | Japan | 2-292292 |
| Mar. 27, 1991 | [JP] | Japan | 3-062807 |
| Jun. 27, 1991 | [JP] | Japan | 3-156484 |

[51] Int. Cl.[5] ..... F25B 41/04

[52] U.S. Cl. ..... 62/204; 62/228.3; 236/78 D

[58] Field of Search ..... 62/228.3, 228.4, 204; 236/78 D

[56] References Cited

U.S. PATENT DOCUMENTS 4,926,653 5/1990 Masuda et al. ..... 62/228.4

FOREIGN PATENT DOCUMENTS 0058050 3/1988 Japan ..... 62/228.4

*Primary Examiner*—William E. Wayner

*Attorney, Agent, or Firm*—Stevens, Davis Miller & Mosher

[57] ABSTRACT

A multi-system air conditioner comprises an exterior unit including a compressor and a plurality of interior units, each being installed in a room and including a heat exchanger and an expansion valve therefor. An opening degree of the expansion valve in an interior unit is controlled based on not only the superheat degree of the compressor but also the room temperature difference. Further, the control based on the superheat degree is carried out by means of the fuzzy logical calculation on superheat degree value. A rotational speed of the compressor is controlled based on not only the load capacity of the room but also the room temperature difference. Further, a control based on the fuzzy logical calculation on the pressure value is added. A feed forward control is also added so as to shorten the transient time.

24 Claims, 11 Drawing Sheets

MULTI-SYSTEM AIR CONDITIONER

FIELD OF THE INVENTION

The present invention relates generally to a multi-system air conditioner, and more particularly to a multi-system air conditioner of the type in which a degree of opening of an expansion valve in each room as well as a rotational speed of a compressor can be properly controlled.

A conventional multi-system air conditioner comprises an exterior unit and a plurality of interior units. The exterior unit comprises a compressor, a four-way valve for switching the air-conditioning cycle, an exterior heat exchanger, a receiver and an accumulator, which are connected to one another in this order. Each of the interior units comprises an interior heat exchanger, an interior expansion valve and a room temperature detector. They are installed in each room. The gas side and liquid side of the exterior unit are connected respectively to the gas side and liquid side of each interior unit via a gas pipe and a liquid pipe to form a closed circuit. A pressure detector is mounted on the gas pipe. The closed circuit is filled with a refrigerant to provide a heat pump cycle of a known type.

In such a multi-system air conditioner, it is necessary to control the room temperature in accordance with the load of each room and also necessary to control the pressure representing the quantity of state of the cycle reflecting the sum of the loads.

To this end, in the conventional multi-system air conditioner, a room temperature control device of each room and a pressure control device set a desired degree of opening of the expansion valve and a desired rotational speed of the compressor through PID control in accordance with a room temperature deviation Di representing a difference between the desired room temperature and the detected room temperature and with a pressure deviation Ep representing a difference between the desired pressure level and the detected pressure level.

Here, when coefficients of a proportional operator, an integral operator and a derivative operator of the room temperature control device and the pressure control device in each room are set suitably in accordance with a variation of the output of each room temperature detector corresponding to a variation of the commands Ui for the opening degree of the interior expansion valve, and with a variation of the output of each pressure detector corresponding to a variation of the commands Uc for the rotational speed of the compressor, the room temperature deviation Di and the pressure error Ep become both zero under suitable response. That is, the desired room temperature is obtained.

However, in such a multi-system air conditioner, the opening degree commands Ui for each interior expansion valve are set only in accordance with the outputs of each room temperature detector regardless of the degree of superheat at an intake portion of the compressor. Therefore, for example, on varying the set room temperature, the opening degree commands Ui for each interior expansion valve are varied, so that the superheat degree may become extremely low or high. Also, even though each room temperature deviation Di becomes zero, that is, in an equilibrium condition, the superheat degree may become extremely low or high in connection with the load of each room. Further, since the rotational speed command Uc for the compressor is set only in accordance with the output of the pressure detector regardless of the output of each room temperature detector, the compressor rotational speed command Uc relative to the load of each room becomes extremely low or high. Accordingly these may cause the problem that each room temperature deviation Di is not rendered to zero, or the electric power consumption in the compressor becomes excessive, or the compressor may be damaged by a liquid refrigerant returning phenomenon in which the liquid refrigerant is returned into the compressor.

Further, since the opening degree command value Ui for each interior expansion valve as well as the rotational speed command Uc for the compressor is determined by a feedback control, it takes much time for each room temperature deviation Di to be brought into zero.

OBJECT AND SUMMARY OF THE INVENTION

It is an object of this invention to provide a multi-system air conditioner which overcomes the above-mentioned problems of the prior art.

To this end, in the present invention, in order to deal with the problem that the superheat degree at the intake side of a compressor becomes extremely high or low, there is provided a superheat degree detector for detecting the superheat degree at the intake side of the compressor, and also provided a superheat degree controller for determining an command for an opening degree of each of interior expansion valve so as to coincide the superheat degree to a set value. In a first measure, the opening degree command value Ui for the respective interior expansion valve is determined by the sum of the manipulated variable determined by the superheat degree controller and the manipulated variable determined by the control operation based on a difference between a room temperature deviation Di and an average Dav of the room temperature deviations. In a second measure, the manipulated variable determined by the superheat degree controller in accordance with a membership value determined by a superheat degree fuzzy logical calculation using the superheat degree as an input therefor is added to the respective manipulated variable determined by each room temperature controller, thereby determining the opening degree command value Ui of the respective expansion valves.

In order to deal with the problem that the rotational speed of the compressor becomes extremely low or high with respect to the load of each room, as the first method, a rotational speed command Uc for the compressor is to be set equal to a manipulated variable determined by a control operation based on the sum of product of the room temperature deviations Di (i.e., the differences between the room temperatures and the desired temperatures) and the standard load capacities representing the rated capacities of the interior units. In a second measure, the manipulated variable, determined by a pressure controller in accordance with a membership value determined by a fuzzy logical calculation on the pressure value using the pressure as an input therefor, is added to the manipulated variable determined by the first measure so as to determine the rotation speed command Uc of the compressor.

Further, to deal with the problem that it takes much time for each deviation to become zero, a feedforward control is applied to the room temperature control.

With the above arrangement, the superheat degree control and the room temperature control can be available independently each other, and then the room temperature can be controlled within a proper range of the superheat degree.

Further, the rotational speed of the compressor can be controlled in accordance with the load of each room, and also the rotational speed of the compressor can be optimized in a specified pressure range.

With the above arrangements, the output of each room temperature detector can be coincided with the set temperature, so that the electric power consumption of the compressor can be minimized. The damage to the compressor due to the liquid refrigerant returning phenomenon can be prevented.

Further, the response time for each room temperature control, when changing the set room temperature or when starting the operation, can be shortened.

DETAILED DESCRIPTION OF THE PREFERRED EMBODIMENTS

Figure 1:
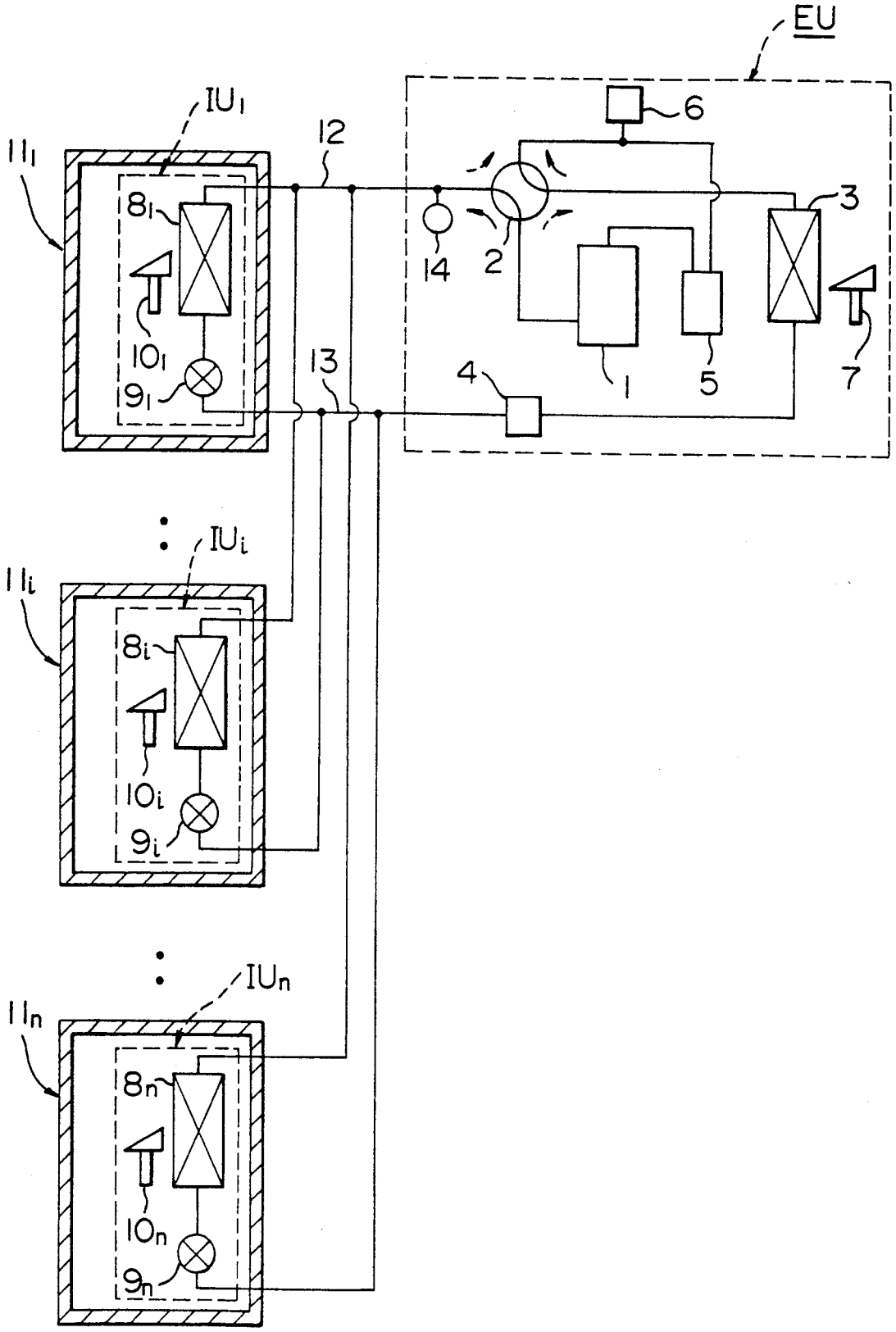
FIG. 1 is a schematic view of a multi-system air conditioner according to a first embodiment the present invention.

Referring to FIG. 1, a multi-system air conditioner according to one embodiment of the present invention comprises an exterior unit EU and n interior units IUi (i=1, . . . , n). The exterior unit EU comprises a compressor 1, a four-way valve 2 for switching an air conditioning cycle, an exterior heat exchanger 3, a receiver 4 and an accumulator 5. A superheat degree detector 6 is provided at an intake portion of the compressor 1. A temperature detector 7 for detecting the atmosphere temperature of the exterior unit is also provided.

Each interior unit IUi (i=1, 2, . . . , n) comprises an interior heat exchanger 8*i*, an interior expansion valve 9*i* and a room temperature detector 10*i*. The interior units IUi are installed in rooms 11*i*, respectively. The exterior unit EU is connected to the interior units IUi via a gaseous refrigerant pipe 12 and a liquid refrigerant pipe 13 to form a closed circuit. The closed circuit is filled with refrigerant so as to form a heat pump cycle. A pressure detector 14 is connected to the gaseous refrigerant pipe 12.

The operation of the multi-system air conditioner of the above construction will now be described. During a heating operation, the refrigerant is compressed by the compressor 1 into gaseous refrigerant of high temperature and high pressure. The gaseous refrigerant is fed to the gaseous refrigerant pipe 12 through the four-way valve 2 switched over as shown in a solid line and then reaches the interior heat exchanger 8*i* in each interior unit IUi. At this time, each interior heat exchanger 8*i* serves as a condenser. The gaseous refrigerant is condensed in the exchanger 8*i* into a condensate so as to heat the air in each room 11*i*. The condensate flows to the exterior heat exchanger 3 via the interior expansion valve 9*i*, the liquid refrigerant pipe 13 and the receiver 4. At this time, the exterior heat exchanger 3 serves as an evaporator. The refrigerant is evaporated by the heat of the outside air into low-pressure gaseous refrigerant and flows into the compressor 1 via the four-way valve 2 and the accumulator 5.

To the contrary, in a cooling operation, the four-way valve 2 is so switched over that the refrigerant flows as shown in a broken line. The exterior heat exchanger 3 serves as a condenser and the interior heat exchanger 8*i* serves as an evaporator, so that the heat is absorbed from the air in each room 11*i*, thereby cooling the room 11*i*.

Next, the operation of each interior expansion valve 9*i* will now be described. When the degree of opening of each expansion valve 9*i* increases, the flow rate of the cooling medium increases. The room temperature in each room 11*i* rises during the heating operation and in contrast drops during the cooling operation. The room temperature is detected by the room temperature detector 10*i*.

The operation of the compressor 1 will now be described. When the rotational speed (number of revolution) of the compressor 1 increases, the flow rate of the refrigerant increases. The pressure of the cooling medium in the gaseous refrigerant pipe 12 increases during the heating operation (at this time, the gaseous refrigerant pipe 12 serves as a high-pressure conduit) and in contrast the pressure of the refrigerant in the gaseous refrigerant pipe 12 decreases during the cooling operation (at this time, the gaseous refrigerant pipe 12 serves as a low-pressure conduit). The pressure is detected by the pressure detector 14.

The operation of the multi-system air conditioner of the above construction will now be described. When the set room temperature is varied, the opening degree of each interior expansion valve 9*i* is varied accordingly, so that the degree of superheat becomes extremely low or high. Further, even when the room temperature detected by the detector 10*i* coincides with the set room temperature (that is, in an equilibrium condition), the superheat degree may become extremely low or high in connection with the load of each room 11*i*. The superheat degree is detected by the superheat degree detector 6.

Figure 2:
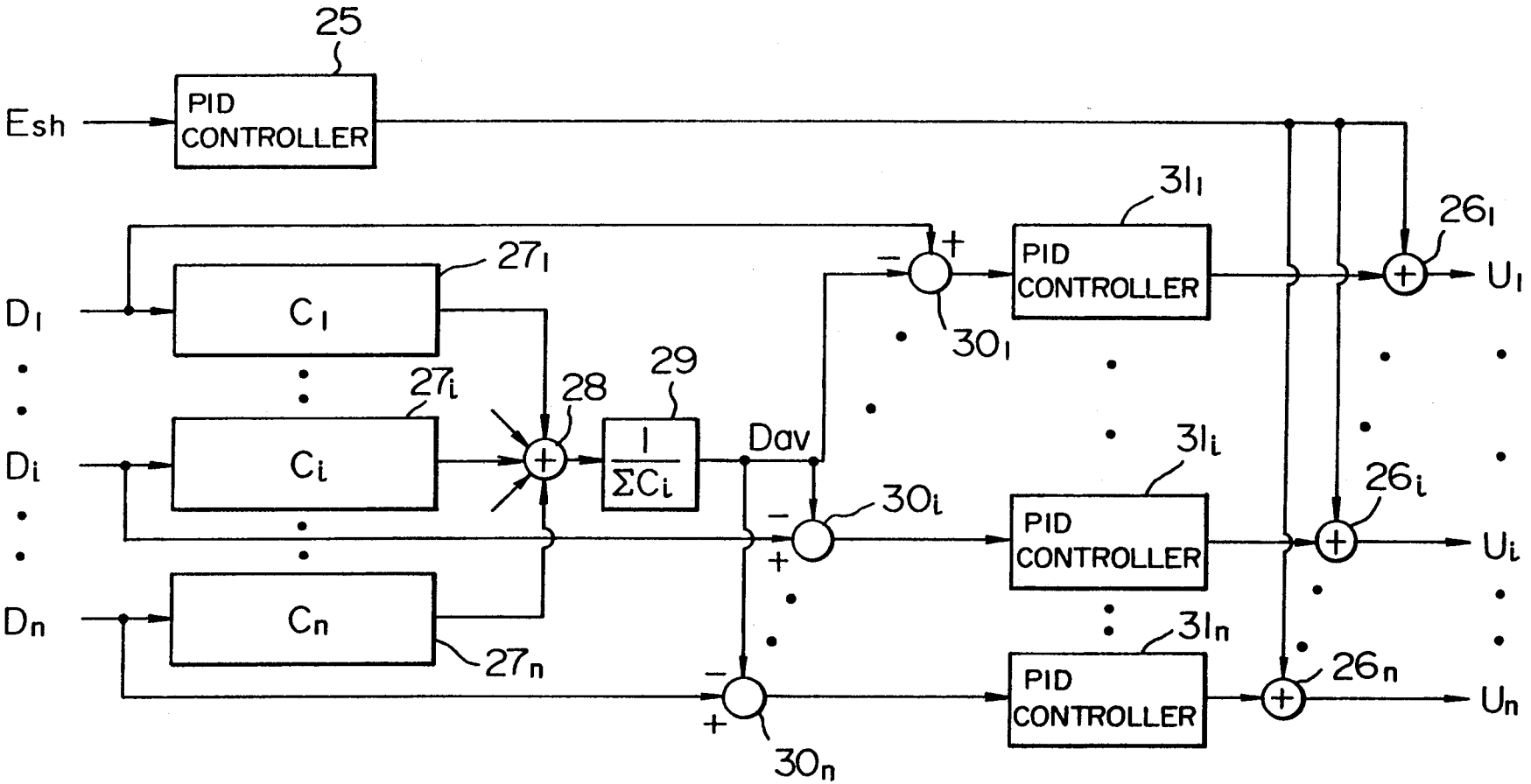
FIG. 2 is a block diagram of control of expansion valves used in the conditioner shown in FIG. 1.

As shown in FIG. 2, the superheat degree detected by the superheat degree detector 6 is compared with a desired superheat degree, and a deviation Esh therebetween is inputted into a PID controller 25. The PID controller 25 effects a PID operation for controlling the superheat degree based on the deviation Esh. The output of the PID controller 25 is fed to adders 26*i* for obtaining opening degree commands of the expansion valves of the rooms 11*i*. Deviations Di are converted into an average deviation Dav weighted with the loads of the room temperatures, through respective standard load capacities Ci, an adder 28 and a divider 29. The weighted average deviation Dav is fed to a comparator 30*i* and compared with the room temperature deviation Di of each room. Therefore, the output of the comparator 30*i* represents a difference between the room temperature deviation Di of each room and the weighted average deviations Dav. The output of the comparator 30*i* is fed to a PID controller 31*i* where an operation for controlling the expansion valve is effected so as to bring the room temperature coincide with the set room temperature. The output of the PID controller 31*i* is fed to the adder 26*i*. The adder 26*i* adds the expansion valve opening degree command based on the superheat degree deviation Esh to the expansion valve opening degree command based on the room temperature deviation Di. An actual opening degree command Ui of each expansion valve is determined by the result of this addition.

Figure 3:
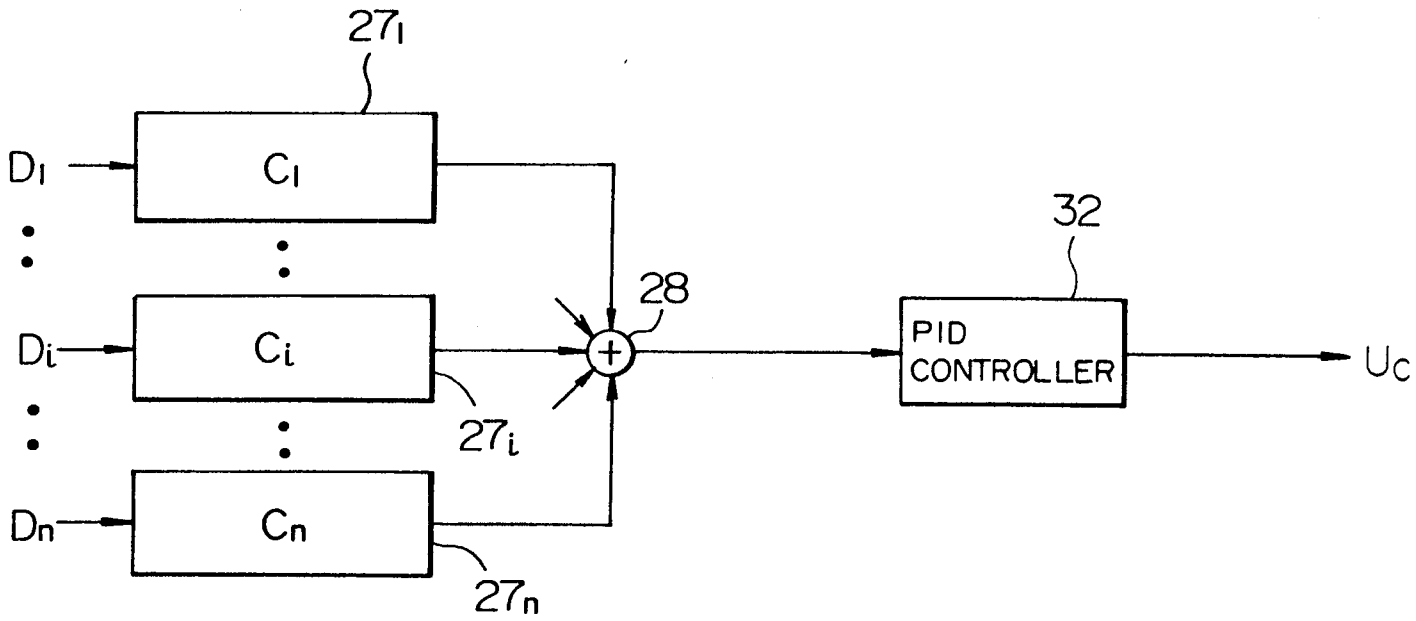
FIG. 3 is a block diagram of control of a compressor in the conditioner shown in FIG. 1.

In order to control the capacity of the compressor 1, the room temperature deviations Di are inputted to an adder 28 via respective standard load capacities Ci, as shown in FIG. 3 in which the same operations as shown in FIG. 2 are designated by identical reference numerals, respectively. Namely, the operation of the following equation is effected:

$$\sum_i (Di \times Ci)$$

In the adder 28, the sum of products of the room temperature deviation Di and the thermal load capacities Ci is calculated and the result thereof is inputted to a PID controller 32. The PID controller 32 effects a compressor rotational speed control operation for bringing the room temperature coincide with the set temperature. A compressor rotational speed command Uc is determined by the result of operation of the PID controller 32.

Namely, the superheat degree of the heat pump cycle is controlled by the information representative of the average of the opening degrees of the expansions valves of the room 11*i*, and the thermal distribution is controlled by the deviation from the average value of the expansion valve opening degrees, based on the room temperature deviation. Similarly, based on the room temperature deviation, a feedback control system for the total quantity of heat is constituted in the compressor control.

Figure 4:
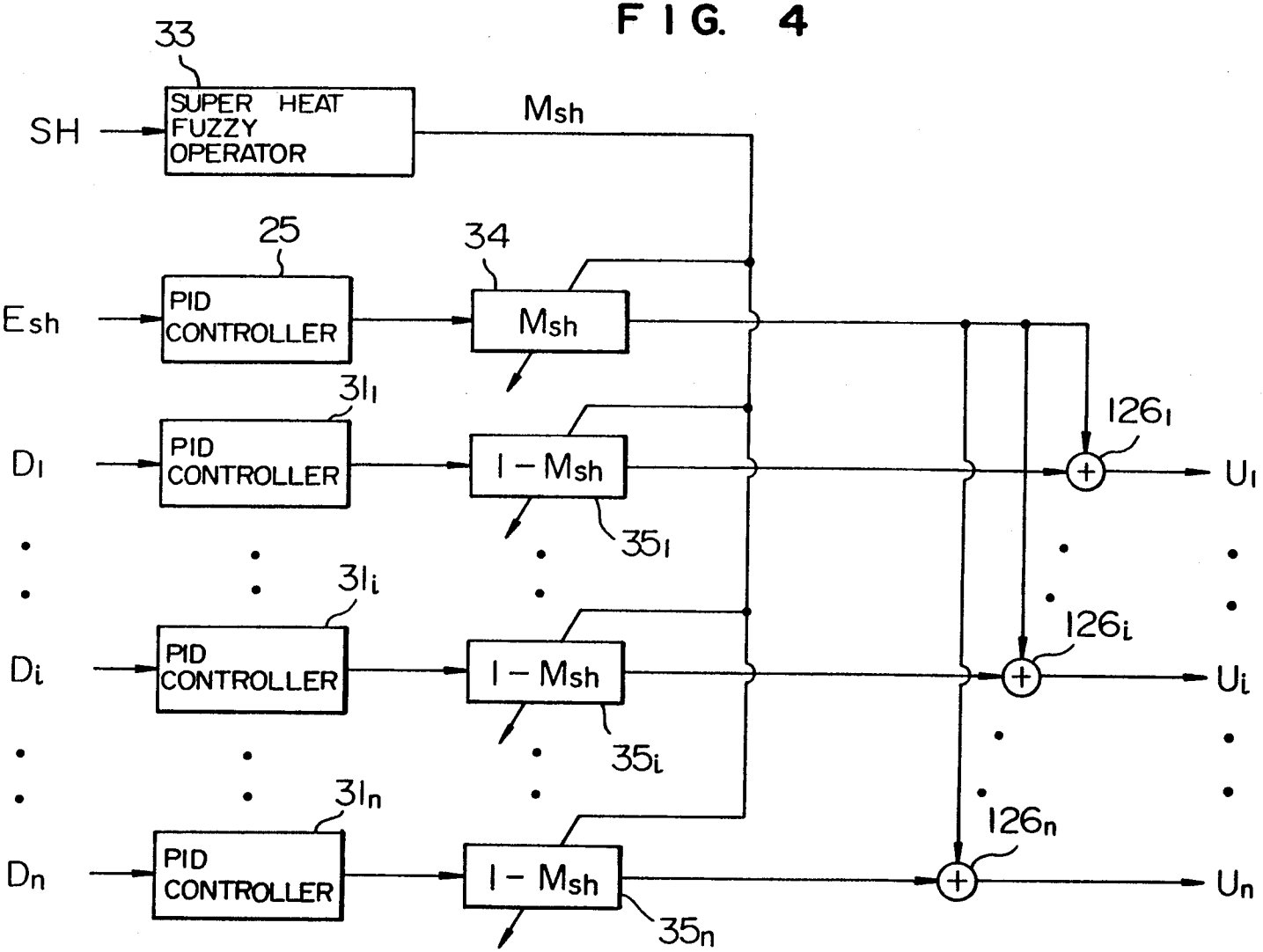
FIG. 4 is a block diagram of control of expansion valves in a second embodiment.

In a second embodiment of the invention shown in FIG. 4 (in which the same operations as shown in FIG. 2 are designated by identical reference numerals, respectively), the superheat degree SH detected by the superheat degree detector 6 is inputted to a superheat degree fuzzy operator 33 where a membership value Msh in the range of 0 to 1 is obtained in accordance with a membership function and the detected superheat degree. In accordance with this membership value, a coefficient (=Msh) of a superheat degree control factor multiplier 34 as well as a coefficient (=1 Msh) of each room temperature control multiplier 35*i* is determined. The superheat degree SH is compared with a desired superheat degree, and a deviation Esh therebetween is inputted to a PID controller 25. The PID controller 25 effects a PID operation for controlling the superheat degree. The output of the PID controller 25 is fed through the superheat degree control multiplier 34 to the adders 126*i* for respectively controlling the expansion valves of the rooms 11*i*. The deviations Di of the detected temperatures from the set temperatures are fed respectively to PID controllers 31*i* where an expansion valve control operation is effected for bringing the room temperature coincide with the set temperature. The output of the PID controller 31*i* is fed via the room temperature control multiplier 35*i* to the adder 126*i* for controlling the expansion valve of each room. In the adder 126*i*, the expansion valve opening degree command based on the superheat degree deviation Esh is added to the expansion valve opening degree command based on the room temperature deviation Di. The result of this addition determines an actual opening degree Ui of each expansion valve.

Figure 5:
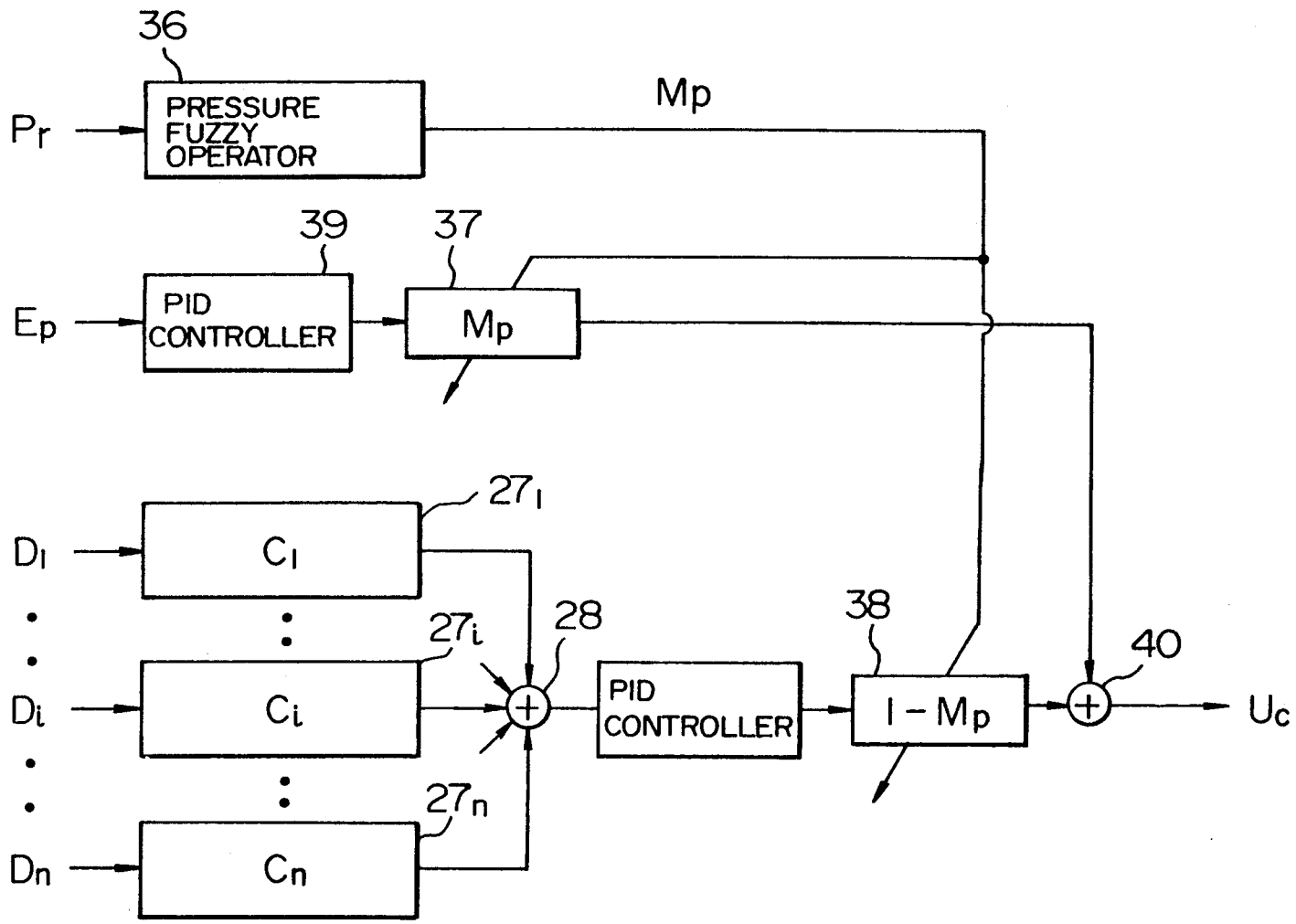
FIG. 5 is block diagram of control of a compressor in the second embodiment.

In order to control the capacity of the compressor 1, as shown in FIG. 5 (in which the same operations as shown in FIG. 3 are designated by identical reference numerals, respectively), the pressure Pr detected by the pressure detector 14 of FIG. 1 is inputted to a pressure fuzzy operator 36 where a pressure membership value Mp in the range of 0 to 1 is obtained in accordance with the a membership function and the detected pressure Pr. In accordance with this membership value, a coefficient (=Mp) of a pressure control multiplier 37 as well as a coefficient (=1 Mp) of a total capacity control multiplier 38 is determined. The detected pressure Pr is compared with a desired pressure, and a deviation Ep therebetween is inputted to a PID controller 39. The PID controller 39 effects a PID operation for controlling the pressure. The output up of the PID controller 39 is fed via the pressure control multiplier 37 to an adder 40 for controlling the rotational speed of the compressor. The same as shown in FIG. 3, the room temperature deviations Di are inputted to an adder 28 via the respective standard load capacities Ci of the rooms 11*i*. In the adder 28, the sum of products of the room temperature deviations Di and the thermal load capacities Ci for the rooms 11*i* is calculated, and then the result thereof is inputted to a PID controller 32. The PID controller 32 effects a compressor rotational speed control operation so as to bringing the detected room temperature coincide with the set temperature. The output of the PID controller 32 is fed to an adder 40 via the total capacity control multiplier 38. In the adder 40, the compressor rotational speed command based on the pressure error Ep is added to the compressor rotational speed command based on the room temperature deviations Di. The result of this addition determines an actual compressor rotational speed command Uc.

Figure 6:
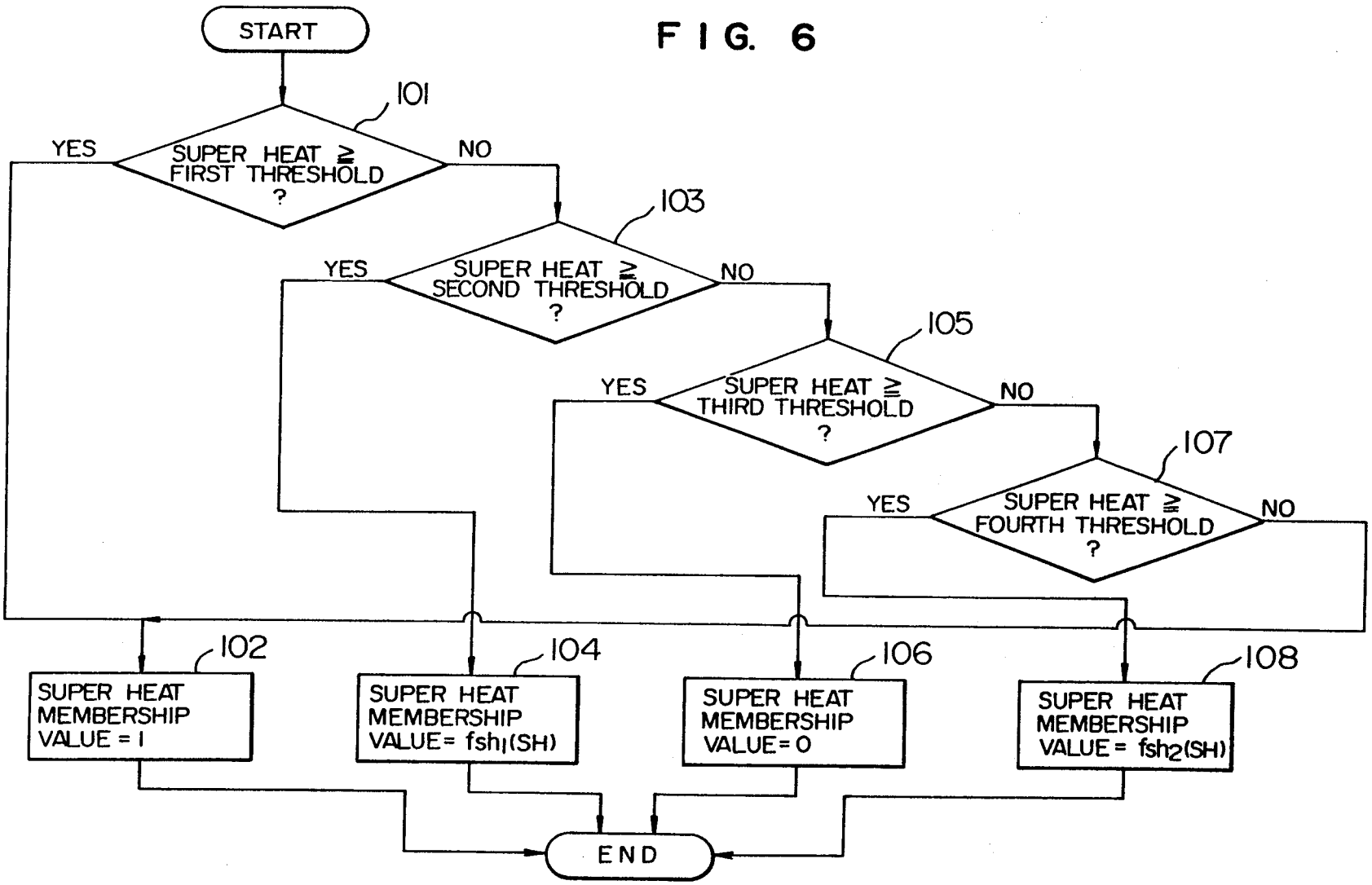
FIG. 6 is a flow chart of an operation of a superheat degree fuzzy operator in the second embodiment.

As shown in FIG. 6, the fuzzy logical calculation 33 on superheat degree value, at first, compares the output of the superheat degree detector 23 with a first superheat degree threshold value (Step 101). Then, if the output of the superheat degree detector 23 (or the detected superheat degree) is equal to or greater than the first superheat degree threshold value, the superheat degree membership value is set to "1" (Step 102). In contrast, if the detected superheat degree is smaller than the first superheat degree threshold value, it proceeds to the Step 103. Namely, the detected superheat degree is compared with a second superheat degree threshold value superheat degree threshold value which is smaller than the first superheat degree threshold value. If the detected superheat degree is equal to or greater than the second superheat degree threshold value, there is set by a superheat degree membership function $Fsh_1(SH)$ which varies in a monotonous and continuous manner in the range of 1 to 0 in accordance with the detected superheat degree SH (Step 104). In contrast, if the detected superheat degree is smaller than the second superheat degree threshold value, it proceeds to the Step 105. Namely, the detected superheat degree is compared with a third superheat degree threshold value which is smaller than the second superheat degree threshold value (Step 105). If the detected superheat degree is equal to or greater than the third superheat degree threshold value, the superheat degree membership value is set to "0" (Step 106). In contrast, if the detected superheat degree is smaller than the third superheat degree threshold value, it proceeds to the step 107. Namely, the detected superheat degree is compared with a fourth superheat degree threshold value which is smaller than the third superheat degree threshold value. If the detected superheat degree is equal to or greater than the fourth superheat degree threshold value, the superheat degree membership value is set by a superheat degree membership function $Fsh_2(SH)$ which varies in a monotonous and continuous manner in the range of 1 to 0 in accordance with the detected superheat degree SH (Step 108). In contrast, if the detected superheat degree is smaller than the fourth superheat degree threshold value, the superheat degree membership value is set to "1" (Step 102). Thus the superheat degree membership value Msh are determined.

Figure 7:
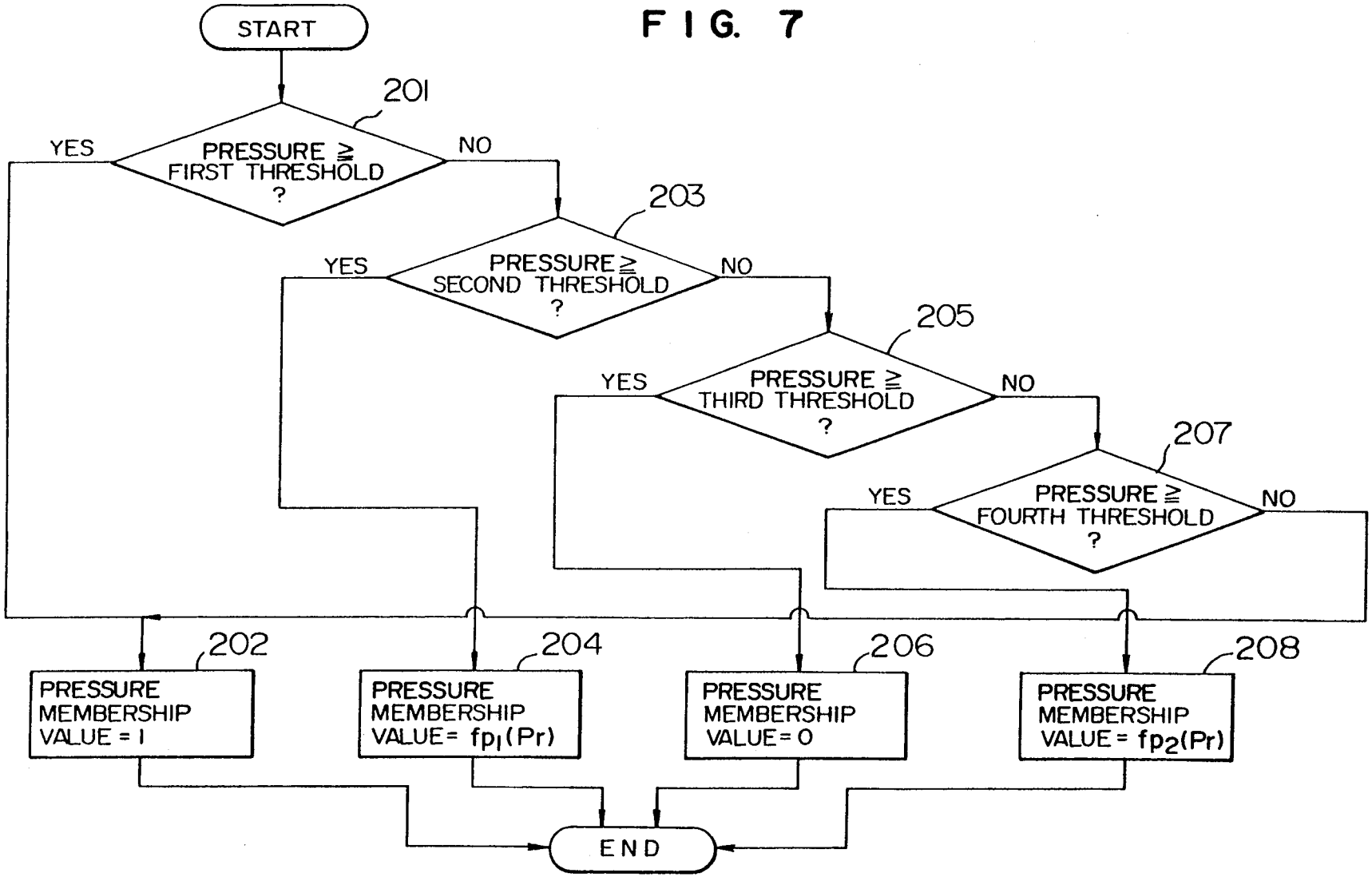
FIG. 7 is a flow chart of the operation of a pressure fuzzy operator in the second embodiment.

As shown in FIG. 7, the pressure fuzzy operator 36, at first, compares the pressure detected by the detector 14 with a first pressure threshold value (Step 201). If the detected pressure is equal to or greater than the first pressure threshold value, the pressure membership value is set to "1" (Step 202). In contrast, if the detected pressure is smaller than the first pressure threshold value, it proceeds to the step 203. Namely the detected pressure is compared with a second pressure threshold value which is smaller than the first pressure threshold value. If the detected pressure is equal to or greater than the second pressure threshold value, the pressure membership value is set by the pressure membership function $F_{p1}(Pr)$ which varies in a monotonous and continuous manner in the range of 1 to 0 in accordance with the detected pressure (Step 204). In contrast, if the detected pressure is smaller than the second pressure threshold value, it proceeds to the step 205. Namely the detected pressure is compared with a third pressure threshold value which is smaller than the second pressure threshold value. If the detected pressure is equal to or greater than the third pressure threshold value, the pressure membership value is set to "0" (Step 206). In contrast, if the detected pressure is smaller than the third pressure threshold value, it proceeds to the step 207. Namely the detected pressure is compared with a fourth pressure threshold value which is smaller than the third pressure threshold value. If the detected pressure is equal to or greater than the fourth pressure threshold value, the pressure membership value is set by the pressure membership function $F_{p2}(Pr)$ which varies in a monotonous and continuous manner in the range of 0 to 1 in accordance with the detected pressure (Step 208). In contrast, if the detected pressure is smaller than the fourth pressure threshold value, the pressure membership value is set to "1" (Step 202). Thus the pressure membership values Mp are determined.

Namely, when the superheat degree is in the appropriate range, that is, in the range of between the second superheat degree threshold value and the third superheat degree threshold value (FIG. 6), the opening degree of the expansion valve of each room is controlled based on the room temperature deviation Di. When the superheat degree deviates much from the above appropriate range (that is, the superheat degree is greater than the first superheat degree threshold value, or is smaller than the fourth superheat degree threshold value (FIG. 6)), the opening degree of the expansion valve of each room is controlled based on the superheat degree error Esh. When the superheat degree is in an intermediate range (that is, in the range of between the first and the second superheat degree threshold values, or in the range of between the third and the fourth superheat degree threshold values (FIG. 6)), the actual expansion valve opening degree of each room is controlled in accordance with a combination of the expansion valve opening degree command based on each room temperature deviations Di and the expansion valve opening degree command based on the superheat degree error Esh.

The control of the compressor is carried out in a similar manner. More specifically, when the pressure is in the appropriate range (that is, in the range of between the second pressure threshold value and the third pressure threshold value (FIG. 7)), the rotational speed of the compressor is controlled based on the room temperature deviations Di. When the pressure deviates much from the above appropriate range (that is, the pressure is greater than the first pressure threshold value, or is smaller than the fourth pressure threshold value (FIG. 7)), the rotational speed of the compressor is controlled based on the pressure error Ep. When the pressure is in an intermediate range (that is, in the range of between the first and the second pressure threshold values or in the range of between the third and the fourth pressure threshold values (FIG. 7)), a rotational speed of the compressor is controlled in accordance with a combination of the compressor rotational speed command based on each room temperature deviation Di and the compressor rotational speed command based on the pressure error Ep.

Figure 8:
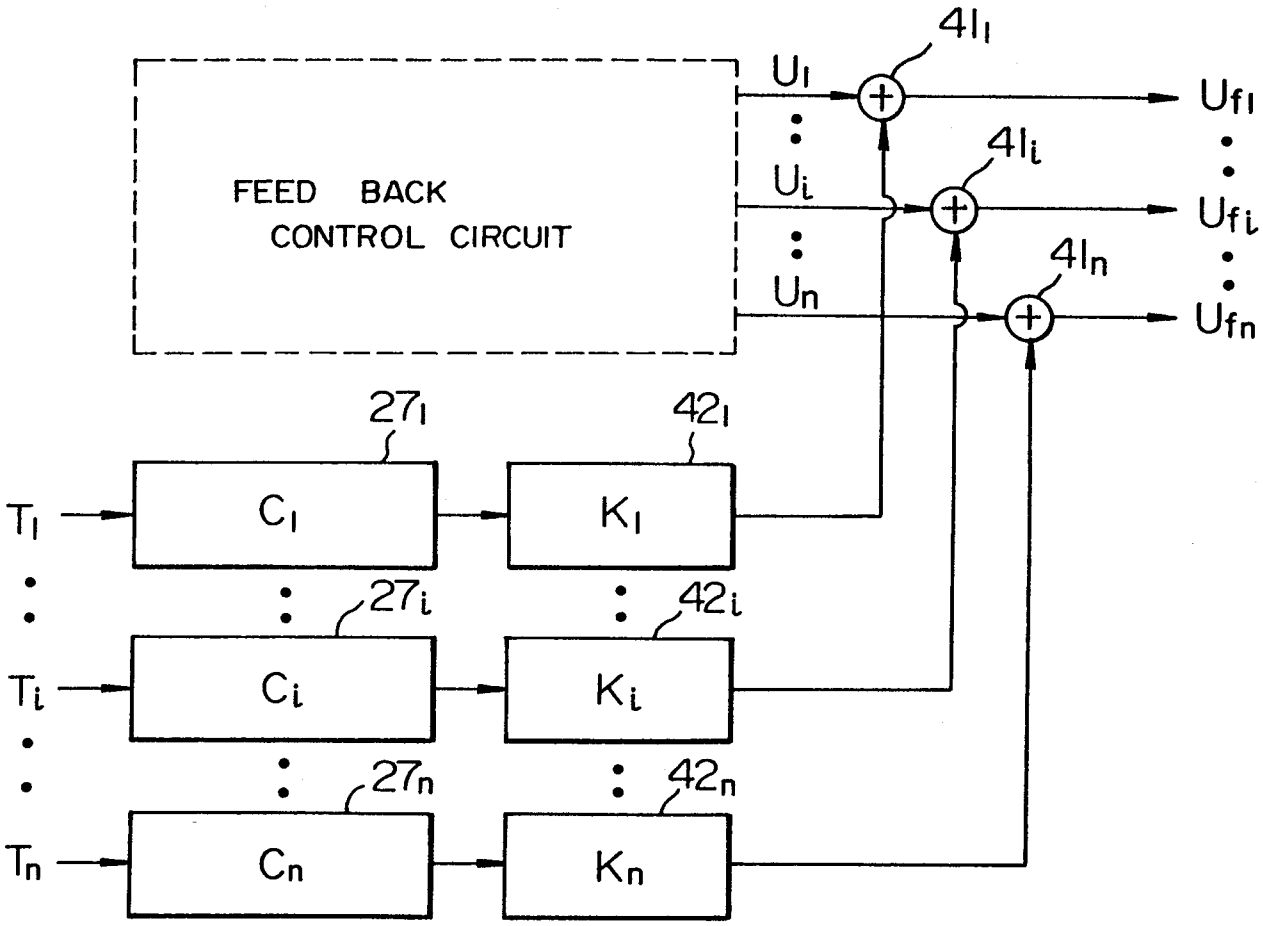
FIG. 8 is a block diagram of control of expansion valves in a third embodiment.

In a third embodiment of the invention shown in FIG. 8 (in which the same operations as shown in FIG. 2 are designated by identical reference numerals, respectively), the expansion valve opening degree command Ui of each room according to the feedback control of FIG. 2 or FIG. 4 is fed to an adder 41*i*. A deviation Ti of the outside temperature detected by the outside temperature detector 24 from a set temperature is inputted to a standard load capacity 27*i* where the deviation Ti is multiplied by a coefficient of a standard load for each interior unit IUi to provide a necessary heat quantity which is fed therefrom to a conversion multiplier 42*i*. In the conversion multiplier 42*i*, the output from the standard load capacity 27*i* is multiplied by a conversion coefficient Ki which is determined depending on how much the flow rate of the refrigerant need to be increased in accordance with the heat quantity, and then converted to the opening degree of the interior expansion valve 9*i*. The output of the conversion factor multiplier 42*i* is fed to the adder 41*i*. In the adder 41*i*, the expansion valve opening degree command Ui from the feedback control of FIG. 2 or FIG. 4 is added to the expansion valve opening degree command based on the thermal load. The result of this addition represents an actual expansion valve opening degree command Ufi of each room.

Figure 9:
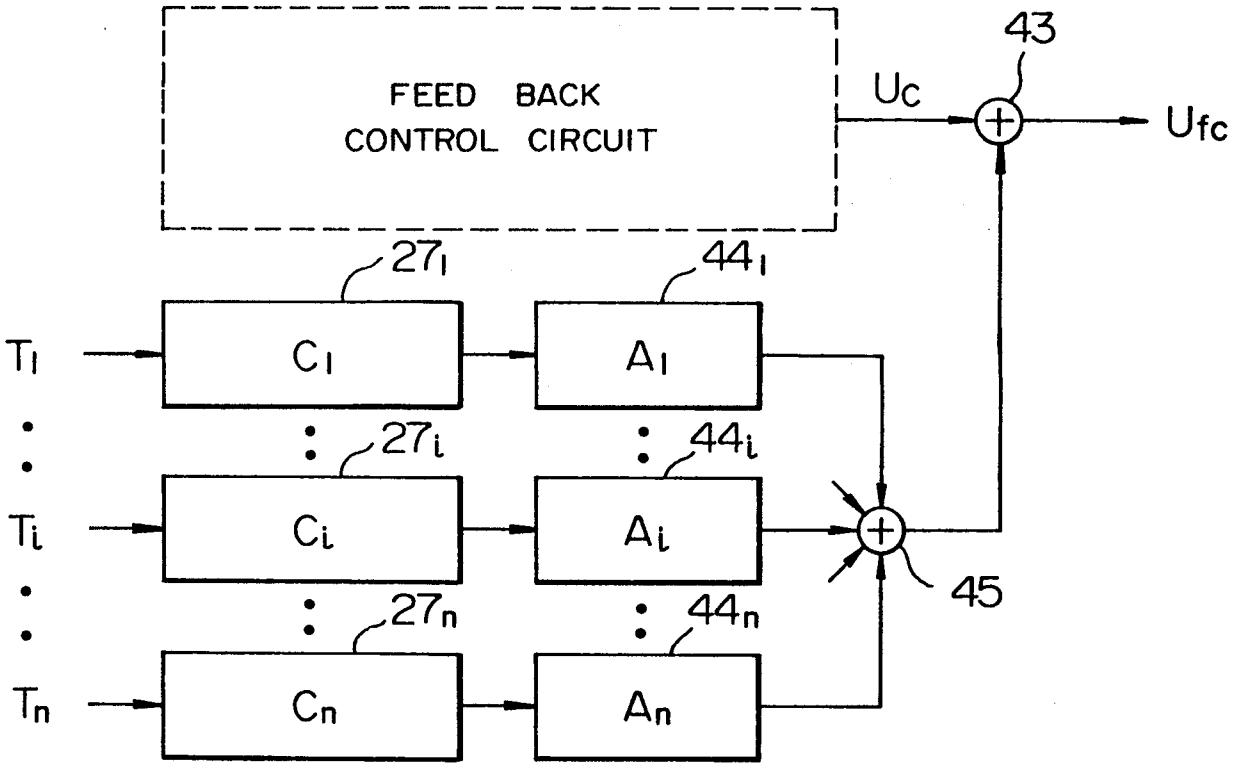
FIG. 9 is a block diagram of control of a compressor in the third embodiment.

In order to control the capacity of the compressor 1, as shown in FIG. 9 (in which the same operations as shown in FIG. 8 are designated by identical reference numerals, respectively), the compressor rotational speed command Uc in accordance with the feedback control of FIG. 3 or FIG. 5 is fed to an adder 43. A deviation Ti between the outside temperature detected by the outside temperature detector 7 and the set temperature is inputted to a standard load capacity 27*i* where the deviation Ti is multiplied by a coefficient of a standard load for each interior unit IUi to provide a necessary heat quantity. The necessary heat quantity is fed therefrom to a conversion multiplier 44*i*. In the conversion multiplier 44*i*, the output from the standard load capacity 27*i* is multiplied by a conversion factor Ai which is determined depending upon how much the rotational speed of the compressor need to be increased in accordance with the heat quantity, and is converted to the rotational speed of the compressor 1. The output of each conversion multiplier 44*i* is fed to an adder 45. Namely, the operation of the following equation is effected:

$$\sum_i (Ai \times Ci \times Ti)$$

The output of the adder 45 is fed to the adder 43. In the adder 43, the compressor rotational speed command value Uc in accordance with the feedback control of FIG. 3 or FIG. 5 is added to the compressor rotational speed command based on the thermal load. The result of this addition determines an actual compressor rotational speed command Ufc.

Namely, in addition to the expansion valve opening degree command Ui of each room in accordance with the feedback control of FIG. 2 or FIG. 4, the heat quantity in a steady condition is further added as a feedforward control variable in accordance with the difference between the outside temperature and the set temperature. The control of the compressor is carried out in a similar manner. More specifically, in addition to the compressor rotational speed command Uc in accordance with the feedback control of FIG. 3 or FIG. 5, the heat quantity in a steady condition is further added as a feedforward control variable in accordance with the difference between the outside temperature and the set temperature.

By the use of the above controllers, although the room temperature control and the superheat degree control or the room temperature control and the pressure control can be carried out independently, it is necessary to know the actual load capacity of each room in order to carry out more accurate or fine controls.

Figure 10:
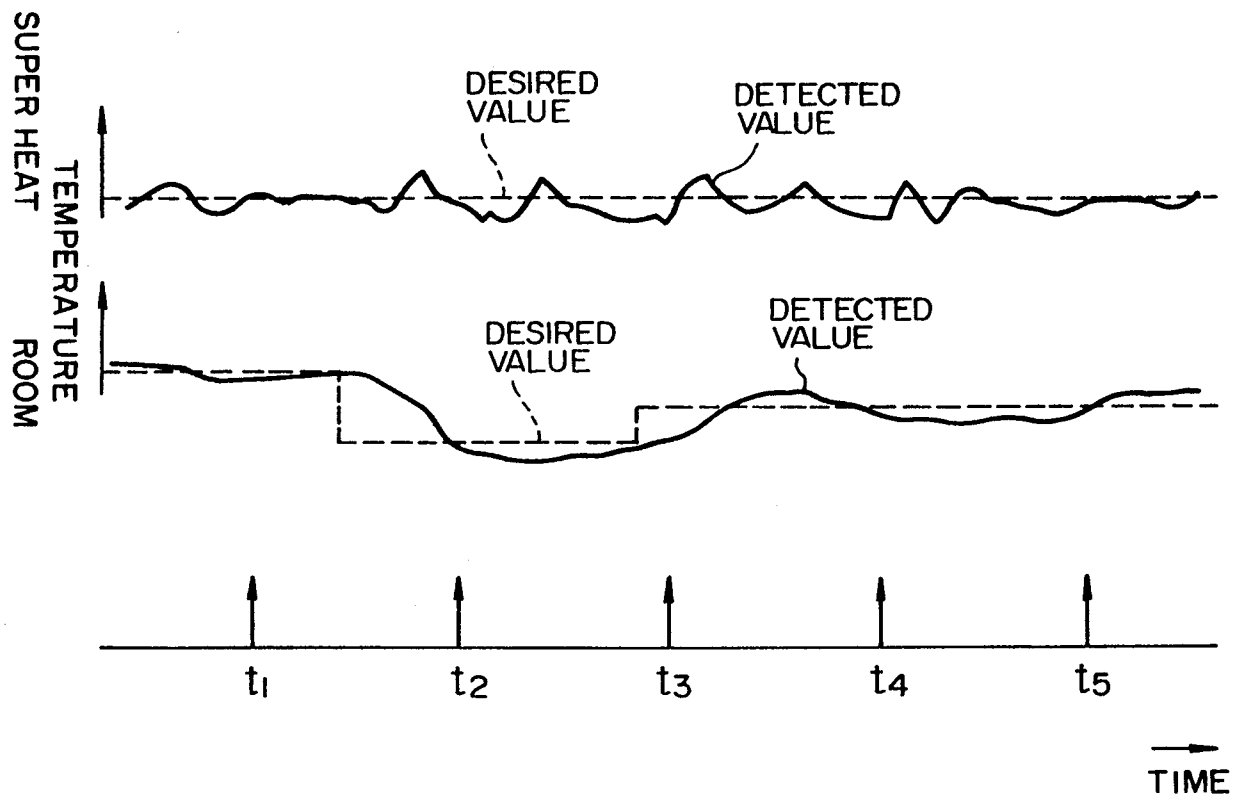
FIG. 10 is a diagram showing estimated operations of load capacity equivalents in one embodiment of the invention.

The timing of the change of the superheat degree, the change of the room temperature, and the check and renewal of parameters of the performance functions will be described with reference to FIG. 10. At time t2, obtained are the performance indexes J's of the superheat degree error Esh and the room temperature deviation Di of each room during a time period from time t1 to time t2. During the period from time t1 to time t2, the control computer performs the control operations according to the room temperature deviations Di, the superheat degree error Esh and the set load capacity equivalents, as well as calculates the performance indexes J's. The indexes J's are obtained, for example, by a performance function expressed by the following equation:

$$J = \sum_i \left( (Esh)^2 \cdot \sum_i (Di)^2 \right)$$

This equation represents the sum of products obtained by multiplying the square of the room temperature deviations Di by the square of the superheat degree error Esh. Namely, the larger the room temperature deviation of each room becomes or the larger the superheat degree error Esh becomes, the larger the index J becomes. Therefore, it can be said that the smaller the index J becomes, the better the control condition becomes. Based on the index J at this time, new control parameter (for example, the load capacity Ci) is determined for the next period from time t2 to time t3. The manner of this determination will be described later. Similarly, such calculation is repeated at the times t3 and so on.

Figure 11A:
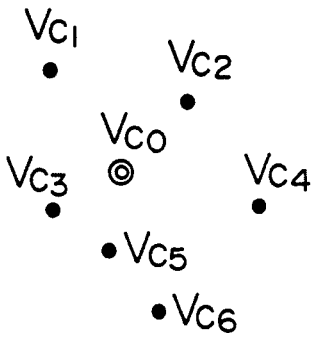
FIGS. 11A-11D a view showing the procedure of estimating the load capacity equivalents in an embodiment of the invention.

The principle of renewal of the parameters in the performance function will now be described. This principle is based on a method so called "a simplex method". FIG. 11A shows the setting of a simplex (polyhedron) in its initial condition. $V_{C1}, V_{C2}, \ldots, V_{Ck}$ shown are vector quantities composed of parameter groups. For example, elements of $V_{C1}$ is composed of the parameters of the performance function for determining the load capacity of each room. Therefore, the dimension of the vector $V_{Cj}$ equals the number of the interior units. $V_{C0}$ represents the parameter vector when the load capacity of each room is to be a standard load condition of each interior unit.

The values of the initial vectors $V_{C1}, V_{C2}, \ldots, V_{Ck}$ are set to the values by which the value of $V_{C0}$ is small perturbed. The amount of such small perturbation is selected randomly. In this manner, the values of the initial vectors $V_{C1}, V_{C2}, \ldots, V_{Ck}$ are determined. The value of k is set to the number larger by at least one than the number of the interior units. Next, the control is performed by using the initial vectors $V_{C1}, V_{C2}, \ldots, V_{Ck}$ for a predetermined time period, and the the performance indexes J's at this time are calculated. After the index calculation, the indexes are re-arranged in the order of excellence thereof. The performance function has the best index contains the vector $V_{C1}$, and the performance function has the worst index contains the vector $V_{Ck}$.

Figure 11B:
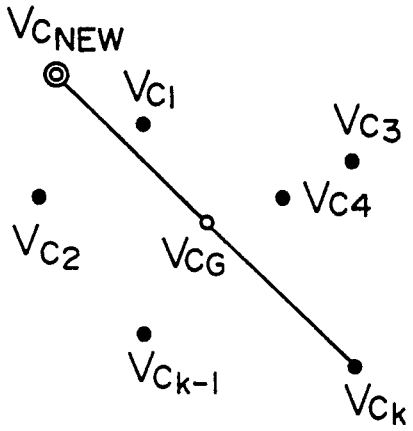

Next, a processing shown in FIG. 11B is carried out. Namely, the vector $V_{Ck}$ corresponding to the worst index is reflected with respect to the center of gravity $V_{CG}$ of the other vectors to form a new vector $V_{Cnew}$. The control is carried out again using $V_{Cnew}$ to obtain a new performance index. If the new performance index thus obtained is better than the index of $V_{Ck-1}$, the $V_{Cnew}$ is newly employed instead of $V_{Ck}$, and the index based thereof is also employed. The indexes are re-arranged again in the order of excellence thereof, and the processing of FIG. 11B is carried out again. In contrast, if the new performance index is not better than the index of $V_{Ck-1}$, a processing shown in FIG. 11C is carried out.

Figure 11C:
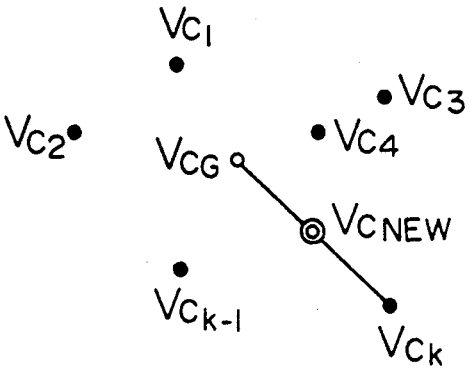

The processing of FIG. 11C shows the reflection of the vector close to the center of gravity of the vectors. More specifically, the mid point between $V_{Ck}$ and $V_{CG}$ is defined as $V_{Cnew}$. Based on the thus obtained new vector $V_{Cnew}$, the control is carried out and obtain a new index. If the new index is better than the index of $V_{Ck-1}$, the $V_{Cnew}$ is employed instead of $V_{Ck}$ and the index thereof is also employed. The vectors are rearranged again in the order of excellence thereof, and the processing of FIG. 11B is again carried out. In contrast, if the new is not better than the index of $V_{Ck-1}$, a processing shown in FIG. 11D is carried out.

Figure 11D:
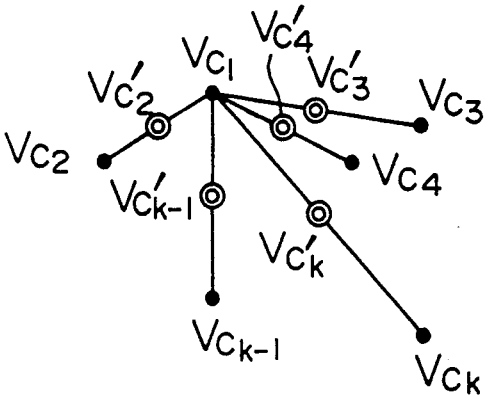

The processing of FIG. 11D shows a processing in which all the vectors except for the vector $V_{C1}$ having the best index are arranged close to the vector $V_{C1}$. Namely, the mid points between the $V_{C1}$ and each of the other vectors are obtained, and these mid points are employed as new vectors $V_{C2'}$, $V_{C3'}$, . . . , $V_{Ck'}$, and based on these new vectors, the control is carried out to obtain new index. Then, the new vectors are rearranged in the order of excellence of the indexes, and the processing of FIG. 11B is again carried out.

When these processings are repeated, the vectors are brought closer to the vectors of the current load capacity equivalent. Therefore, the more accurate control can be achieved.

Generally, it is difficult for such a parameter search to make convergence quickly. However, the initial values are set based on the standard condition of use, and the actual condition of use will not deviate extremely far from the standard condition, and therefore the slow convergence will not pose any practical problem. Besides, even during the convergence, the basic feedback controls are continuously performed, and therefore the control will not be rendered impossible. Namely only the control performance is a little lowered. Thus, this will not pose any practical problem. Further, since the convergence is slow, the variations can be disregarded in the feedback system, and the interference with the feedback system can be disregarded.

In the above embodiment, although the performance function is based on the square of the deviation, it may be based, for example, on the sum of the absolute values of the deviations, and such modification can be made without departing from the scope of the present invention.

Also, in the above embodiments, although the PID control is used as the feedback control operation, the control operation may be a proportional and at least one order derivative control (PD control), or a proportional and at least one order integral control (PI control).

When the operating condition is changed, or when the derivative value exceeds a predetermined threshold value, instead of such derivative values, predetermined values are to be used for the control, thereby preventing an abrupt change of the manipulated variables, so that a good control can be carried out even when the operation condition is changed.

As described above, according to the present invention, there is provided the multi-system air conditioner in which the room temperature control and the heat pump cycle control can be properly carried out by the simple method. By doing so, the superheat degree as well as the pressure is kept at a proper level, so that the consumption of electric power for the compressor can be reduced to a minimum. Further, the damage to the compressor due to the liquid refrigerant returning can be prevented.

Further, the feedforward control can be added to improve the responsibility of the room temperature control.

What is claimed is:

1. A multi-system air conditioner comprising:

an exterior unit including a capacity variable compressor and an exterior heat exchange;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with set temperatures of said rooms, respectively, said control unit comprising means for controlling said compressor in accordance with a rotational speed Uc obtained by the following equations:

$$Up = f1\ (Ep)$$

$$E = \sum_i\ (Ci \times Di)$$

$$Uc = \alpha 1 \times Up + \alpha 2 \times f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, Σ represents an addition operator, and α1 and α2 represent coefficients; and said control unit further controlling said plurality of expansion valves in accordance with opening degree commands Ui (i=1, 2, . . . , n) obtained by the following equations:

$$Ush = f3\ (Esh)$$

$$Ui = \alpha \times Ush + \alpha 4 \times f4\ (Di)$$

where Esh represents a deviation between the detected superheat degree and a desired superheat degree, f3 and f4 represent control operations, and α3 and α4 represent coefficients.

2. A multi-system air conditioner according to claim 1, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

3. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\,(Ep)$$

$$E = \sum_i (Ci \times Di)$$

$$Uc = f2\,(E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, and Σ represents an addition operator; and said control unit further controlling said plurality of expansion valves in accordance with opening degree commands Ui (i=1, 2. . . , n) obtained by the following equations:

$$Ush = f3\,(Esh)$$

$$Dav = \frac{\sum_i (Ci \times Di)}{\sum_i Ci} = E/\sum_i Ci$$

$$Ui = Ush + f5\,(Di - Dav)$$

where Esh represents a deviation between the detected superheat degree and a desired superheat degree, and f3 and f5 represent control operations.

4. A multi-system air conditioner according to claim 3, wherein said control unit controls said expansion valves in accordance with opening degree command Ufi (i=1, 2, . . . , n) determined by the following equation:

$$Ufi = Ui + Ki \times Ci \times Ti$$

where Ti (i=1, 2, . . . , n) represents a difference between the detected outside temperature and the set temperature of each room, and Ki represents a factor; and wherein an command Ufc for the capacity of said compressor is determined by the following equation:

$$Ufc = Uc + \sum_i (Ai \times Ci \times Ti)$$

where Ti (i=1, 2, . . . , n) represents a difference between the detected outside temperature and the set temperature of each room, and Ai represents a constant.

5. A multi-system air conditioner according to claim 4, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

6. A multi-system air conditioner according to claim 3, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

7. A multi-system air conditioner according to claim 3, wherein said control operating fj is represented by a linear sum of at least two operations among a proportional, at least one order derivation and at least one order integration, and wherein said control operation fj includes a derivation of at least one order.

8. A multi-system air conditioner according to claim 3, wherein said control operation fj is represented by a linear sum of at least two operations among a proportional, at least one order derivation and at least one order integration, and wherein said control operation fj includes a derivation of at least one order, and when the operating condition is changed, or when a derivative value of said derivation of said control operation exceeds a predetermined threshold value, the conditioner is operated with setting said derivative value to a predetermined value.

9. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\ (Ep)$$

$$E = \sum_i (Ci \times Di)$$

$$Uc = f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, and Σ represents an addition operator; and said control unit further controlling said plurality of expansion valves in accordance with opening degree commands Ui (i=1, 2, . . . , n) obtained by the following equations:

$$Ush = f3\ (Esh)$$

$$Dav = \frac{\sum_i (Ci \times Di)}{\sum_i Ci} = E/\sum_i Ci$$

$$Ui = Ush + f6\ (Ci \times Di - Dav)$$

where Esh represents a deviation between the detected superheat degree and a desired superheat degree, and f3 and f6 represent conrol operations.

10. A multi-system air conditioner according to claim 9, wherein said control unit controls said expansion valves in accordance with opening degree command Ufi (i=1, 2, . . . n) determined by the following equation:

$$Ufi = Ui + Ki \times Ci \times Ti$$

where Ti (i=1, 2, . . . , n) represents a difference between the detected outside temperature and the set temperature of each room, and Ki represents a factor; and wherein an command Ufc for the capacity of said compressor is determined by the following equation:

$$Ufc = Uc + \sum_i (Ai \times Ci \times Ti)$$

where Ti (i=1, 2, . . . , n) represents a difference between the detected outside temperature and the set temperature of each room, and Ai represents a constant.

11. A multi-system air conditioner according to claim 10, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

12. A multi-system air conditioner according to claim 9, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

13. A multi-system air conditioner according to claim 9, wherein said control operation fj is represented by a linear sum of at least two operations among a proportional, at least one order deviation and at least one order integration, and wherein said control operation fj includes a derivation of at least one order, and when the operating condition is changed, or when a derivative value of said derivation of said control operation exceeds a predetermined threshold value, the conditioner is operated with setting said derivative value to a predetermined value.

14. A multi-system air conditioner according to claim 9, wherein said control operation fj is represented by a linear sum of at least two operations among a proportional, at least one order derivation and at least one order integration, and wherein said control operation fj includes a derivation of at least one order.

15. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\ (Ep)$$

$$E = \sum_i (Ci \times Di)$$

$$Uc = Mp \times Up + (1 - Mp) \times f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, Σ represents an addition operator, and Mp represents a membership value determined by a pressure fuzzy operation using said detected pressure as an input therefor; and said control unit further controlling said plurality of expansion valves in accordance with opening degree commands Ui (i=1, 2, . . . , n) obtained by the following equations:

$$Ush = f3\ (Esh)$$

$$Ui = Msh \times Ush + (1 - Msh) \times f4(Di)$$

where Esh represents a deviation between the detected superheat degree and a desired superheat degree, Msh represents a membership value determined by a superheat degree fuzzy operation using the detected superheat degree as an input therefor, and f3 and f6 represent control operations.

16. A multi-system air conditioner according to claim 15, wherein said control unit controls said expansion valves in accordance with opening degree command Ufi (i=1, 2, . . . , n) determined by the following equation:

$$Ufi = Ui + Ki \times Ci \times Ti$$

where Ti (i=1, 2, . . . , n) represents a difference between the detected outside temperature and the set temperature of each room, and Ki represents a factor; and wherein an command Ufc for the capacity of said compressor is determined by the following equation:

$$Ufc = Uc + \sum_i (Ai \times Ci \times Ti)$$

where Ti (i=1, 2, . . . , n) represents a difference between the detected outside temperature and the set temperature of each room, and Ai represents a constant.

17. A multi-system air conditioner according to claim 16 wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

18. A multi-system air conditioner according to claim 15, wherein said control operation fj is represented by a linear sum of at least two operations among a proportional, at least one order derivation and at least one order integration, and wherein said control operation fj includes a derivation of at least one order, and when the operating condition is changed, or when a derivative value of said derivation of said control operation exceeds a predetermined threshold value, the conditioner is operated with setting said derivative value to a predetermined value.

19. A multi-system air conditioner according to claim 15, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

20. A multi-system air conditioner according to claim 15, wherein said control operation fj is represented by a linear sum of at least two operations among a proportional, at least one order derivation and at least one order integration, and wherein said control operation fj includes a deviation of at least one order.

21. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

a detector for detecting an outside temperature;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\ (Ep)$$

$$E = \sum_i (Ci \times Di)$$

$$Uc = \alpha 1 \times Up + \alpha 2 \times f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, Σ represents an addition operator, and α1 and α2 represent coefficients;

said control unit further controlling said plurality of expansion valves in accordance with opening degree command Ufi (i=1, 2, . . . , n) determined by the following equation:

$$Ufi = Ui + Ki \times Ci \times Ti$$

where Ti (i=1, 2, . . . , n) represents a difference between the detected outside temperature and the set temperature of each room, and Ki represents a factor; and a command Ufc for the capacity of said compressor being determined by the following equation:

$$Ufc = Uc + \sum_i (Ai \times Ci \times Ti)$$

where Ti (i=1, 2, . . . , n) represents a difference between the detected outside temperature and the set temperature of each room, and Ai represents a constant.

22. A multi-system air conditioner according to claim 21, wherein said conditioner further comprises means for finding predetermined performance functions at predetermined time intervals in accordance with the deviations between the set room temperatures and the detected room temperature and the deviation between the detected superheat degree and a desired superheat degree during a time period, and means for correcting said load capacities Ci in accordance with the result of the performance indexes of said performance functions, and wherein said correcting means includes:

(i) a first processing in which values near said standard load capacities Ci of said interior units are set as initial values, respectively, and said conditioner is operated for a predetermined time interval, using different initial values whose number N is larger than the number of said interior units so as to find said performance functions;

(ii) a second processing in which a parameter group of the performance function having the worst performance index is reflected with respect to the center of gravity of parameter groups of the other performance functions to obtain a new parameter group based on which said conditioner is operated for said predetermined time interval to obtain new performance index;

(iii) a third processing in which an interior division point between the parameter group of the performance function having the worst performance index and the center of gravity of the parameter groups of the other performance functions is used as a new parameter group of the performance function based on which said conditioner is operated for said predetermined time interval to obtain new performance index; and (iv) a fourth processing in which the parameter groups of those performance functions except for the parameter group of the performance function having the best performance index are replaced by the interior division points between the parameter groups of said those performance functions and the parameter group of the performance function having the best performance index, so as to find new performance indexes of said those performance functions, and wherein said correcting means performs said second processing subsequently to said first processing, and if the performance index obtained by said second processing is better than the performance index of the performance function which is the (N−1)th best, said second processing is carried out again, and if not, said third processing is carried out, and if the performance index obtained by said third processing is better than the performance index of the performance function which is the (N−1)th best, said second processing is carried out again, and if not, said fourth processing is carried out, and then the processing is returned to said second processing.

23. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\ (Ep)$$

-continued $$E = \sum_i (Ci \times Di)$$

$$Uc = \alpha 1 \times Up + \alpha 2 \times f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent conrol operations, Σ represents an addition operator, and α1 and α2 represent coefficients; said control unit further controlling said plurality of expansion valves in accordance with opening degree commands Ui (i=1, 2, . . . , n) obtained by the following equations:

$$Ush = f3\ (Esh)$$

$$Ui = \alpha 3 \times Ush + \alpha 4 \times f4\ (Di)$$

where Esh represents a deviation between the detected superheat degree and a desired superheat degree, f3 and f4 represent control operations, and α3 and α4 represent coefficients;

said control operation fj being represented by a linear sum of at least two operations among a proportional, at least one order derivation and at least one order integration, and including a derivation of at least one order; and when the operating condition is changed, or when a derivative value of said derivation of said control operation exceeds a predetermined threshold value, the conditioner being operated with setting said derivative value to a predetermined value.

24. A multi-system air conditioner comprising:

an exterior unit including a capacity variable compressor and an exterior heat exchanger;

a plurality of interior units which are installed respectively in rooms, and are connected in parallel to said exterior unit, the number of said interior units being n (≧2), and each of said interior units including an interior heat exchanger, and an expansion valve associated with said interior heat exchanger;

detectors for detecting temperatures of said rooms, respectively;

detectors for detecting set temperatures of said rooms, respectively;

means for detecting an average superheat degree of refrigerant at an outlet side of said heat exchanger serving as an evaporator;

means for determining an average pressure of refrigerant in said interior heat exchangers; and a control unit for controlling said plurality of expansion valves and the capacity of said compressor so as to coincide said temperatures of said rooms with said set temperatures of said rooms, respectively, said control unit comprising means for controlling said compressor in accordance with a rotational speed Uc obtained by the following equations:

$$Up = f1\ (Ep)$$

$$E = \sum_i (Ci \times Di)$$

$$Uc = \alpha 1 \times Up + \alpha 2 \times f2\ (E)$$

where Ci (i=1, 2, . . . , n) represents a standard load capacity of each interior unit, Di (i=1, 2, . . . , n) represents a deviation between the detected room temperature and said set room temperature, Ep represents a deviation between the detected pressure and a desired pressure, f1 and f2 represent control operations, Σ represents an addition operator, and α1 and α2 represent coefficients;

said control unit further controlling said plurality of expansion values in accordance with opening degree commands Ui (i=1, 2, . . . , n) obtained by the following equations:

$$Ush = f3\ (Esh)$$

$$Ui = \alpha 3 \times Ush + \alpha 4 \times f4\ (Di)$$

where Esh represents a deviation between the detected superheat degree and a desired superheat degree, f3 and f4 represent control operations, and α3 and α4 represent coefficients;

said control operation fj being represented by a linear sum of at least two operations among a proportional, at least one order derivation and at least one order integration, and including a derivation of at least one order.

* * * * *